US011774201B2

(12) United States Patent
Plebani et al.

(10) Patent No.: US 11,774,201 B2
(45) Date of Patent: Oct. 3, 2023

(54) FIREARM WITH A TRIGGER GROUP COMPRISING AN ADJUSTMENT DEVICE

(71) Applicant: FABBRICA D'ARMI PIETRO BERETTA S.P.A., Brescia (IT)

(72) Inventors: Ennio Plebani, Brescia (IT); Calogero Spoto, Brescia (IT)

(73) Assignee: FABBRICA D'ARMI PIETRO BERETTA S.P.A., Brescia (IT)

( * ) Notice: Subject to any disclaimer, the term of this patent is extended or adjusted under 35 U.S.C. 154(b) by 0 days.

(21) Appl. No.: 17/968,647

(22) Filed: Oct. 18, 2022

(65) Prior Publication Data

US 2023/0122034 A1 Apr. 20, 2023

(30) Foreign Application Priority Data

Oct. 18, 2021 (IT) ..... 102021000026657

(51) Int. Cl.
*F41A 19/16* (2006.01)

(52) U.S. Cl.
CPC ..... *F41A 19/16* (2013.01)

(58) Field of Classification Search
CPC ..... F41A 19/16; F41A 19/17
USPC ..... 42/69.01–69.3
See application file for complete search history.

(56) References Cited

U.S. PATENT DOCUMENTS

| | | | |
|---|---|---|---|
| 4,391,057 | A | 7/1983 | Bornancini |
| 4,819,358 | A | 4/1989 | Eder |
| 2009/0113777 | A1 | 5/2009 | Williams et al. |

FOREIGN PATENT DOCUMENTS

| | | | |
|---|---|---|---|
| CN | 113720203 | A * | 11/2021 |
| DE | 202015101485 | U1 * | 8/2016 |
| EP | 2 719 989 | A1 | 4/2014 |
| GB | 162 484 | A | 5/1921 |
| RU | 2652859 | C1 * | 5/2018 |

OTHER PUBLICATIONS

Italian Search Report for Italian Patent Application No. 102021000026657 dated May 30, 2022, 2 pages.

* cited by examiner

*Primary Examiner* — Reginald S Tillman, Jr.
(74) *Attorney, Agent, or Firm* — Merchant & Gould P.C.

(57) ABSTRACT

A firearm, such as a rifle, has a trigger group operable by the user in order to control the shooting action. The trigger group includes a trigger and an adjustment device for adjusting the intensity needed to operate the trigger. The adjustment device includes a rod (151) movable by the trigger extending between a trigger end and a free end. A command member engaged with the rod is positionable in a predefined operating axial position. The rod slidably engages with the command member. A thrust spring acts on the rod between the engagement end and the command member. Elastic action of the thrust spring on the trigger is a function of the axial operating position of the command member.

19 Claims, 6 Drawing Sheets

FIREARM WITH A TRIGGER GROUP COMPRISING AN ADJUSTMENT DEVICE

This application claims the benefit of Serial No. 102021000026657, filed 18 Oct. 2021 in Italy and which application is incorporated herein by reference. To the extent appropriate, a claim of priority is made to the above disclosed application.

BACKGROUND OF THE INVENTION

The present invention relates to a firearm.

In particular, the present invention relates to a firearm, preferably a rifle. Specifically, the present invention relates to a rifle preferably, but not necessarily, for hunting.

Known weapons comprise a trigger group operable by the user for commanding the shooting action. With known solutions, the trigger group includes a trigger, the pressing of which commands the firing of the firearm.

In the prior art, it is known to adjust the trigger group by adjusting the intensity necessary to operate the trigger. Preferably, depending on the desired feeling of the user, the trigger is adjusted in a soft configuration, in which a certain, low, force of pressure is required, or in a harder mode, in which a greater force of pressure is required.

Known trigger groups involve specific complex adjustment operations; sometimes they require the disassembly of certain components, sometimes they require the replacement of other components, and in other embodiments they require special tools.

SUMMARY OF THE INVENTION

The object of the present invention is to provide an alternative firearm solution to these known solutions of the prior art, comprising a trigger group in which the aforementioned problems are addressed and solved.

BRIEF DESCRIPTION OF THE DRAWINGS

In addition, further features and advantages of the invention will become clear from the description provided below of preferred embodiments thereof given as non-limiting examples with reference to the attached figures, in which:

FIGS. 1*a*' and 1*b*' show side views of the firearm shown in FIGS. 1*a* and 1*b;*

DETAILED DESCRIPTION OF THE PREFERRED EMBODIMENTS

Figures 1A, 1B:
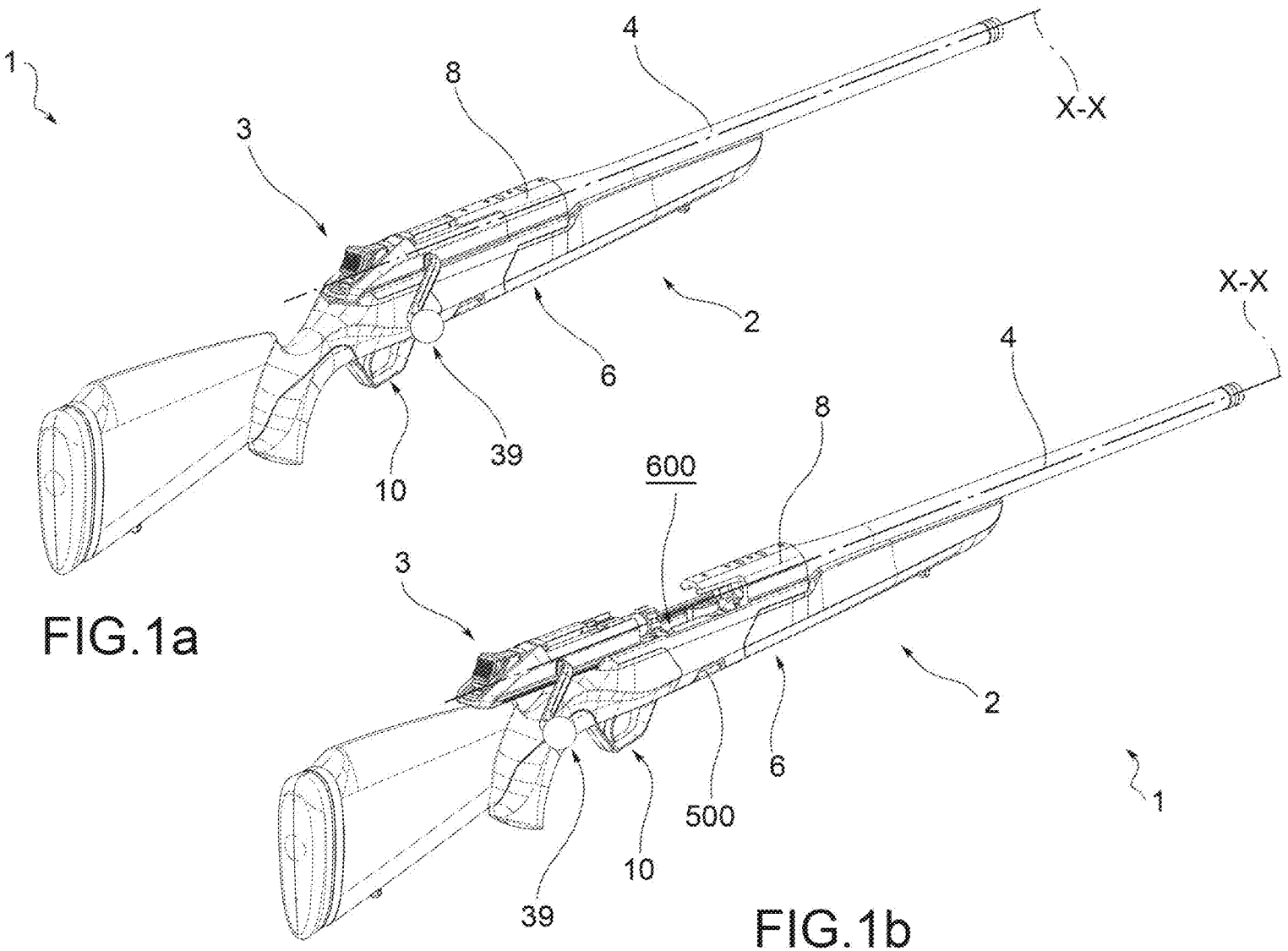
FIGS. 1*a* and 1*b* show, in perspective views, a firearm in accordance with a preferred embodiment comprising a carriage assembly respectively in an advanced firing configuration and in a rearward rearming configuration.
Figure 1A:
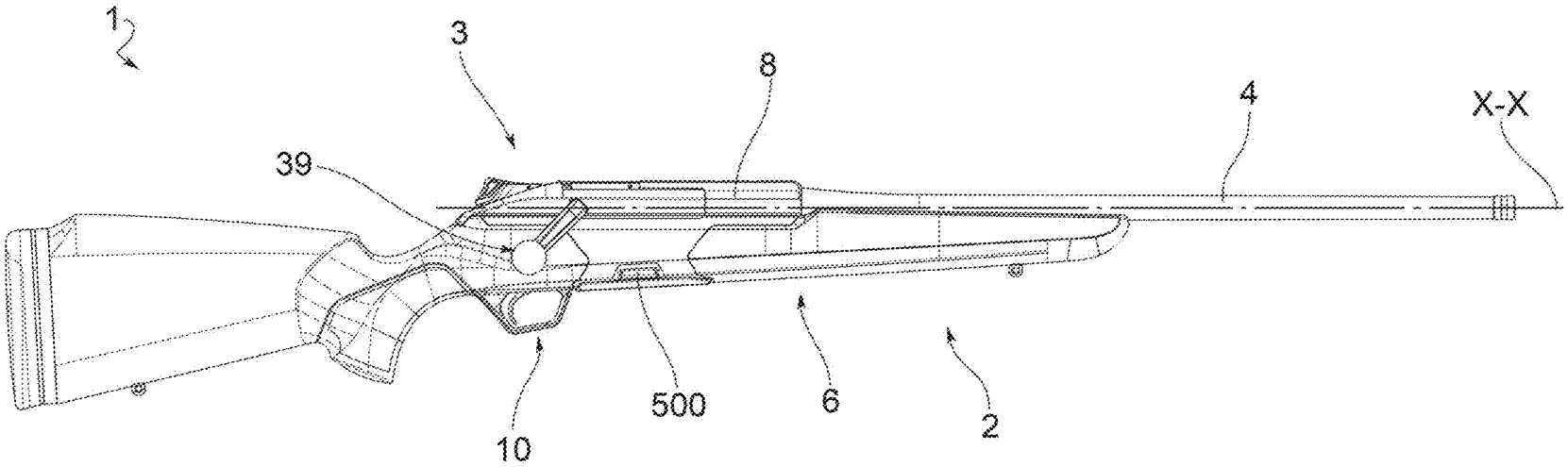
Figure 1B:
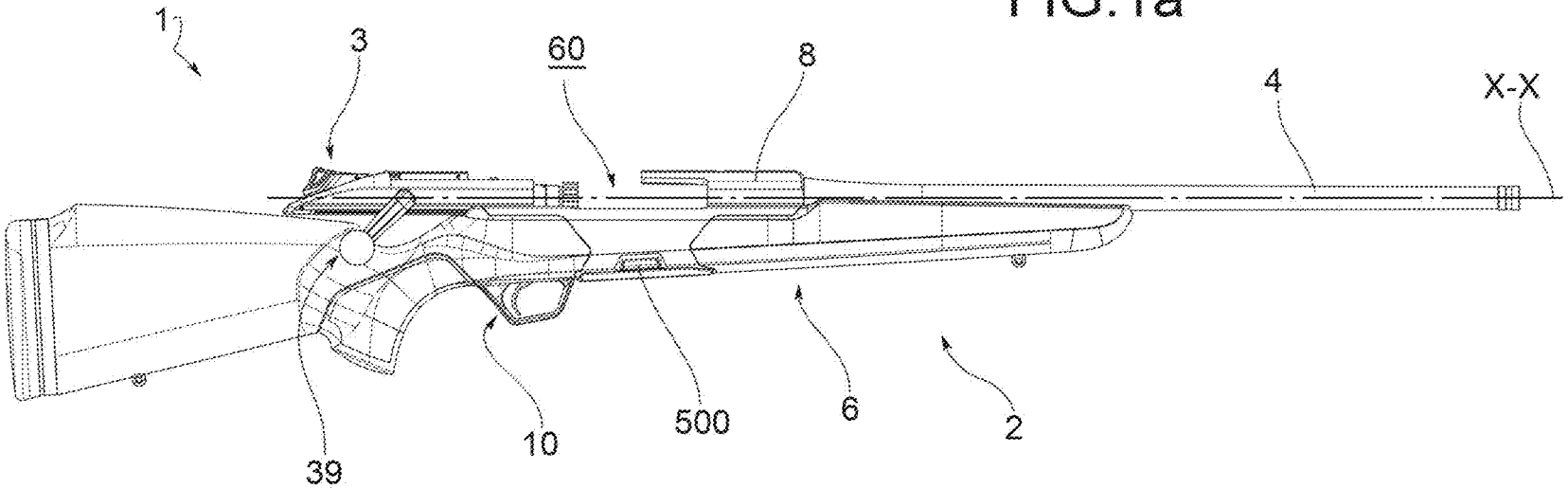
Figure 2:
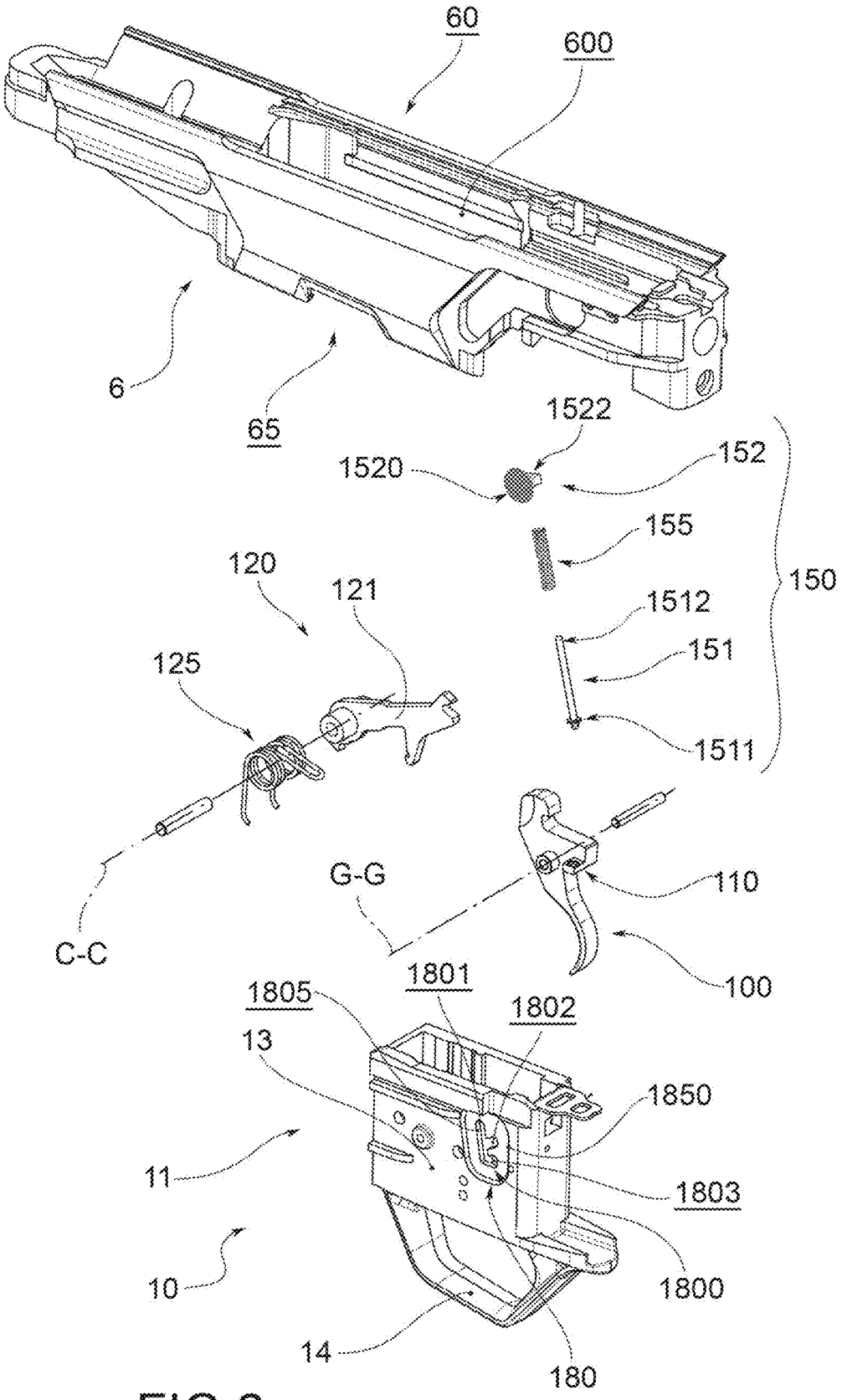
FIG. 2 shows a perspective view of separate parts of certain components included in the firearm in FIGS. 1*a* and 1*b;*
Figure 3:
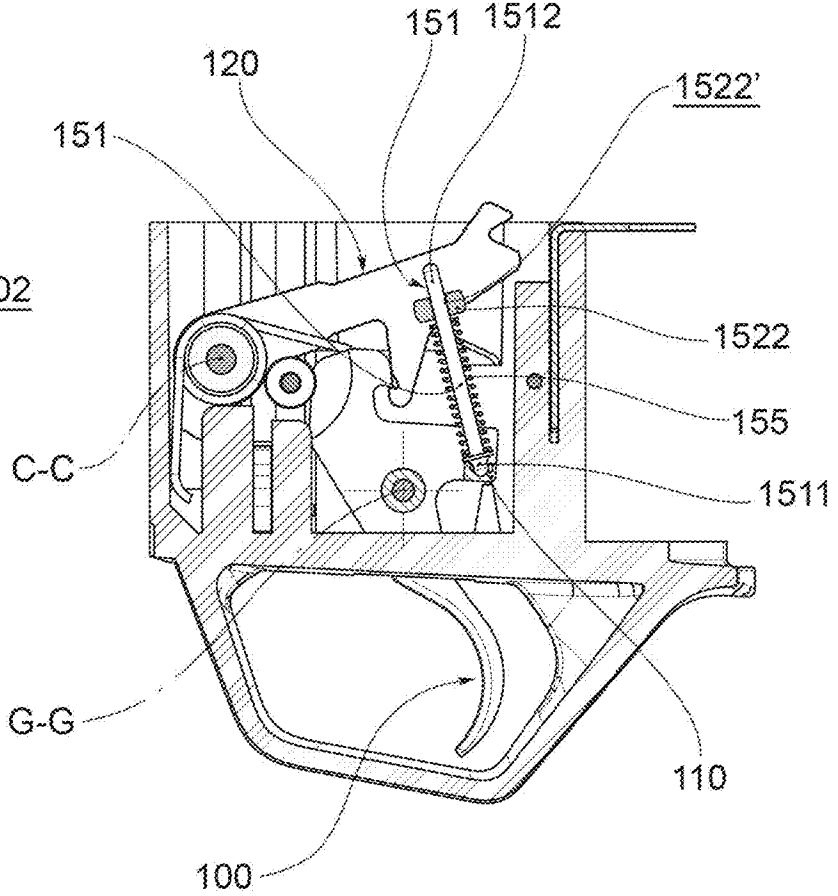
FIGS. 3 and 3' show, respectively, a side view and a longitudinal sectional side view of a trigger group comprised within a firearm according to the present invention, wherein said trigger group is configured in a soft configuration.
Figure 3:
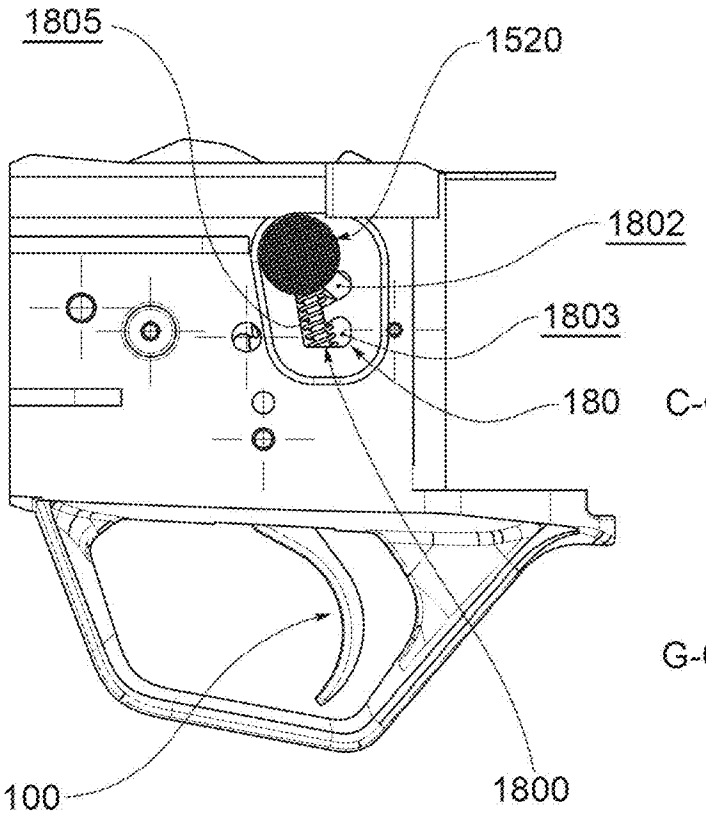
Figure 4:
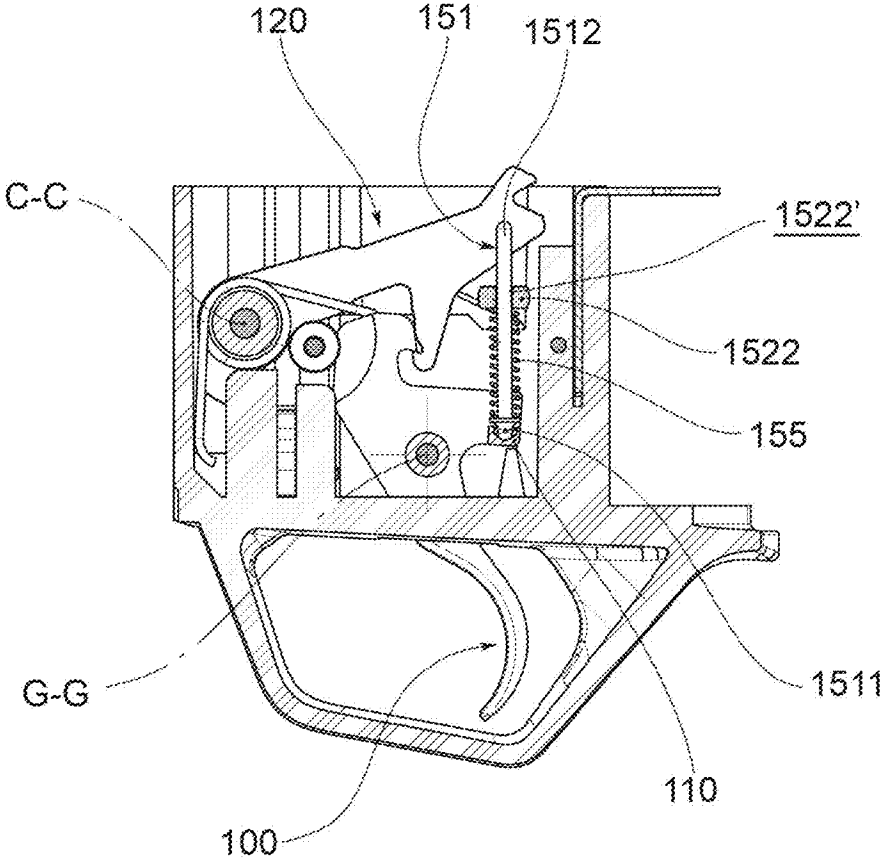
FIGS. 4 and 4' show, respectively, a side view and a longitudinal sectional side view of a trigger group comprised within a firearm according to the present invention, wherein said trigger group is configured in an intermediate configuration.
Figure 4:
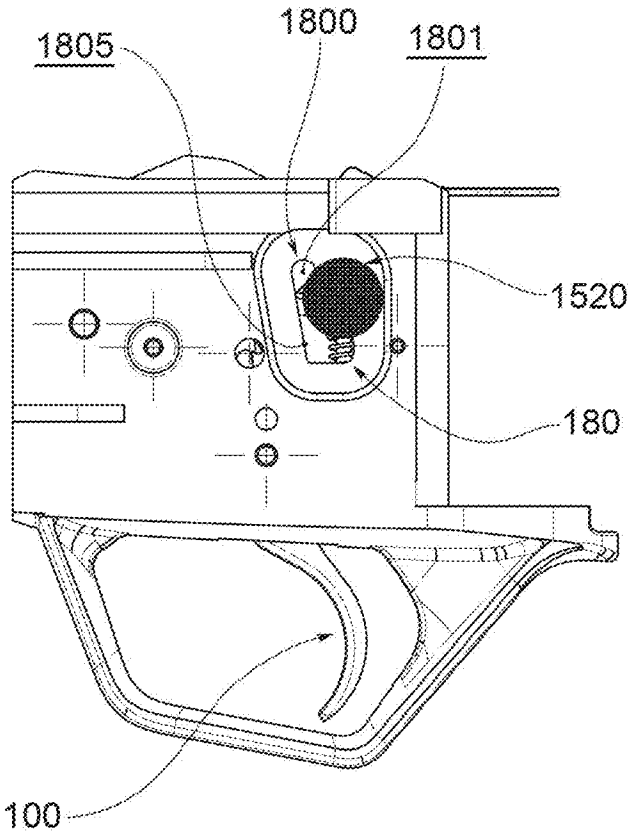
Figure 5:
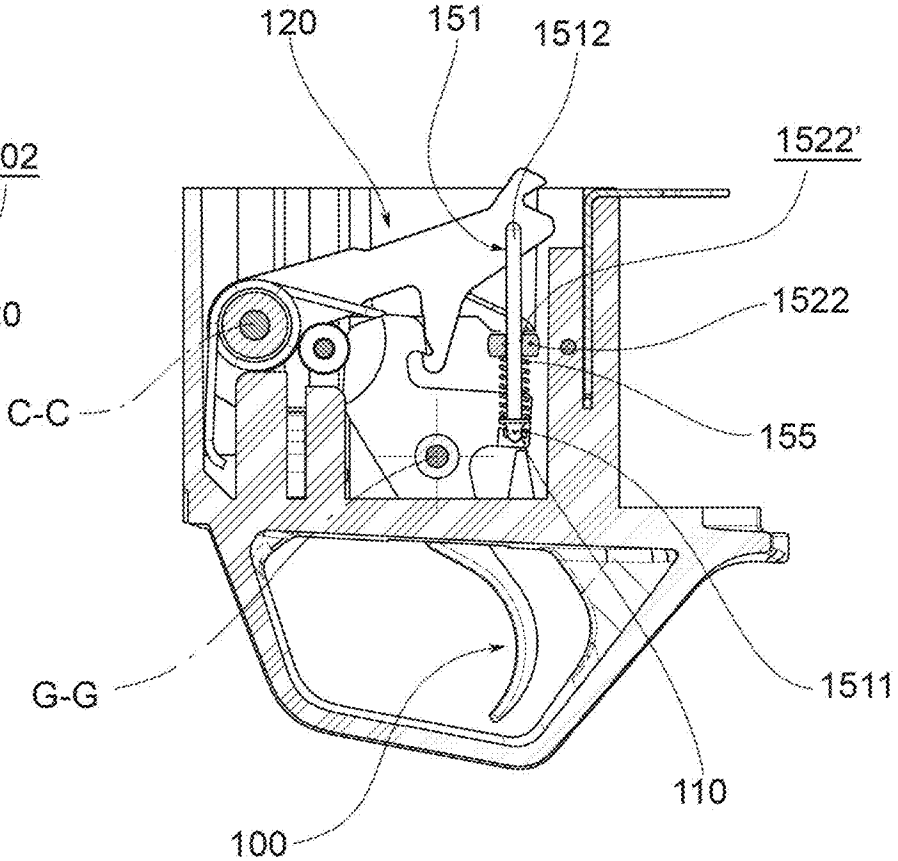
FIGS. 5 and 5' show, respectively, a side view and a longitudinal sectional side view of a trigger group comprised within a firearm according to the present invention, wherein said trigger group is configured in a hard configuration.
Figure 5:
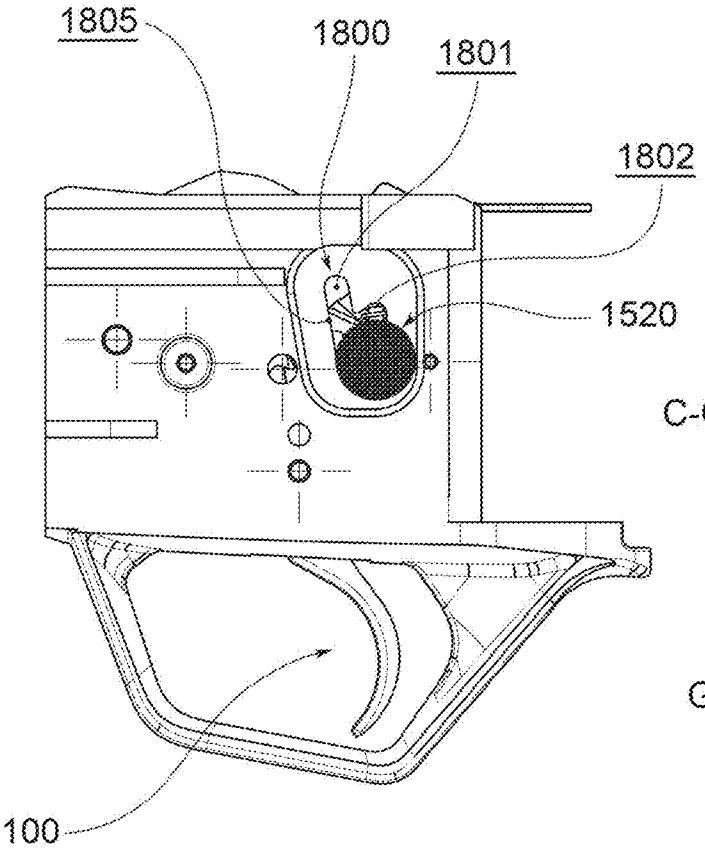

With reference to the accompanying figures, a firearm, in the entirety thereof, according to this invention is indicated with the numeral 1.

In accordance with a preferred embodiment, the firearm 1 is a rifle.

According to a preferred embodiment, the firearm 1 comprises a plurality of components which, by convention, are defined as fixed, and a plurality of components which are defined as movable.

According to a preferred embodiment, the firearm 1 comprises a fixed main body 2. Such a main body 2 is graspable or embraceable by the user for example in shooting or aiming operations, comprising a stock and/or a forend.

According to a preferred embodiment, the fixed body 2 comprises a barrel 4 extending along an axis X-X. The axis X-X is therefore the axis of the barrel.

Preferably, with reference to movements or to certain characteristics or components, "axial" refers to movements or characteristics or components that occur or that are positioned parallel to said axis X-X, i.e., parallel to the barrel 4. In some cases such movements or features or components are along the barrel axis X-X. As an alternative to the term "axial" the term "longitudinal" is also used.

According to a preferred embodiment, the main body 2 comprises a receiver 6.

Preferably, the receiver 6 is made from a material belonging to the family of metals or metal alloys, or polymers, or polymeric materials, or composite materials.

According to a preferred embodiment, the receiver 6 has an upper opening 60. In other words, the receiver 6 has an opening 60 facing in the vertical direction.

In other words, the receiver 6 is a receiver "without a castle".

According to a preferred embodiment, the receiver 6 is a hollow component that is suitable for containing components, shooting mechanisms, and projectiles.

Preferably, the barrel 4 extends from the receiver 6.

Preferably, the stock extends from the receiver 6.

Preferably, the forend extends from the receiver 6.

Preferably, the receiver 6 also comprises a lower opening 65. Projectiles enter through said lower opening 65. Preferably, a magazine 500 is accommodated inside the receiver 6. Preferably, the magazine 500 is inserted through said lower opening 65. Preferably, the magazine 500 closes said lower opening 65.

Preferably, said receiver 6 is hollow and comprises a housing cavity 600.

According to a preferred embodiment, the main body 2 also comprises a breech element 8 positioned at an axial end of said upper opening 60. According to a preferred embodiment, the breech element 8 extends in height, preferably in a vertical direction. Preferably, the barrel 4 is mountable onto the breech element 8 at an end opposite the firing mouth of the barrel 4. In accordance with a preferred embodiment, the breech element 8 is comprised within the barrel 4: the breech element 8 is the axial end opposite the firing mouth of the barrel 4.

In accordance with a preferred embodiment, the aforementioned components, listed in a non-limiting manner, that are part of the main body 2 are all mutually distinct components.

In accordance with an embodiment variant, the aforementioned components, listed in a non-limiting way, that are part of the main body 2 are sometimes mutually connected: some components are integrally connected together.

According to a preferred embodiment, the firearm 1 comprises a carriage assembly 3 comprising a shutter group 5.

Preferably, the shutter group 5 also comprises engageable firing striker members.

More generally, the carriage assembly 3 comprises components, the movements and actuations of which involve a firing action and a reloading action, i.e., discharging the exploded cartridge case to the outside and loading the projectile from the magazine 500.

According to a preferred embodiment, the carriage assembly 3 is positioned on the receiver 6 at the upper opening 60.

Preferably, the carriage assembly 3 is positioned and is shaped in a suitable way to close said upper opening 60.

Preferably, the carriage assembly 3 slides on the axial edges 600 delimiting the upper opening.

In accordance with the present invention, the firearm 1 comprises a trigger group 10 operable by the user in order to perform the shooting action. Preferably, the trigger group 10 interacts with said shutter group 5, in particular with the striker members.

According to the present invention, the trigger group 10 comprises a trigger 100.

Preferably, the trigger 100 is rotatable relative to a trigger axis G-G.

According to a preferred embodiment, the trigger 100 is pivoted on a pin extending along the trigger axis G-G.

Preferably, said trigger axis G-G extends transversely.

According to a preferred embodiment, the trigger group 10 comprises a hammer device 120 engaged by the trigger 100.

Preferably, the hammer device 120 comprises a trigger lever 121 suitable for rotating with respect to a hammer axis C-C.

Preferably, the hammer device 120 comprises a hammer spring 125 suitable for exerting a pushing action against the hammer lever 121.

According to a preferred embodiment, the trigger 100 and the hammer lever 121 are suitable for being engaged.

According to a preferred embodiment, the actuation of the trigger 100 results in releasing the mutual engagement between the trigger 100 and the hammer lever 121 and the latter is subject to rotation and in particular the engagement of the shutter group 3, resulting in the shooting action.

In accordance with the present invention, the trigger group 10 comprises an adjustment device 150 suitable for adjusting the intensity necessary to operate the trigger 100.

In other words, the adjustment device 150 is configurable in a plurality of distinct configurations, in each of which a different action on the trigger 100 is produced.

In accordance with the present invention, the adjustment device 150 comprises a rod 151 movable by the trigger 100.

Said rod 151 extends axially between a trigger end 1511 and a free end 1512.

According to a preferred embodiment, the adjustment device 150 comprises a command member 152 engaged with the rod 151.

Preferably, as described in full below, said engagement of the command member 152 on the rod 151 affects the action of the trigger 100.

According to a preferred embodiment, the command member 152 is positionable on the rod 151 in a predefined axial operating position.

In particular, the rod 151 is slidably engaged with the command member 152. Conversely, the command member 152 is slidably engaged with the rod 151.

In accordance with a preferred embodiment, the adjustment device 150 comprises a thrust spring 155 that is suitable for exerting a thrust action that discharges onto the trigger 100.

In accordance with the present invention, said thrust spring 155 acts on the rod 151 between the engagement end 1511 and the command member 152.

In accordance with a preferred embodiment, the thrust spring 155 is fitted to the rod 151.

In other words, the rod 151 extends along the thrust spring 155.

According to the present invention, the elastic action of the thrust spring 155 on the trigger 100 is a function of the axial operating position of the command member 152.

According to a preferred embodiment, the trigger 100 comprises an engagement portion 110 with which the trigger end 1511 of the rod 151 is engaged.

Preferably, the trigger end 1511 is hinged or pivoted on the engagement portion 110.

Preferably, the engagement portion 110 is positioned radially spaced apart from the trigger axis G-G.

According to a preferred embodiment, the command member 152 is positionable in at least two, preferably three, distinct operating positions. Preferably, the command member 152 is positionable in such a way that the thrust spring 155 is suitable for performing at least two, preferably three, distinct thrust actions on the trigger 100.

According to a preferred embodiment, the command member 152 is movable by a user in order to position it in a preferred operating position, corresponding to a preferred position along the rod 151.

In particular, the user, without the aid of components, and/or without having to disassemble certain components, adjusts the position of the command member 152, thus varying the trigger setting.

In accordance with a preferred embodiment, the command member 152 comprises a command button 1520 engageable by a user.

Preferably, the command button 1520 is operable by means of interacting with a fingertip.

Preferably, the command button 1520 has a knurled surface engageable by the user.

According to a preferred embodiment, the command member 152 comprises a protruding element 1522, extending from said command button 1520 and engaging the rod 151.

Preferably, the protruding element 1522 comprises a through hole 1520' through which the rod 151 is accommodated.

According to a preferred embodiment, the trigger assembly 10 comprises an adjustment region 180 engageable by the command member 152. Preferably, the command member 152 is movable and positionable in a plurality of predefined positions within said adjustment region 180.

According to a preferred embodiment, said adjustment region 180 comprises an adjustment opening 1800 crossed by the command member 152. Preferably, the command button 1520 is positioned on one side of the adjustment region 180, and the rod 151 and the through hole 1520' are positioned on the other side.

According to a preferred embodiment, said adjustment opening 1800 comprises at least two, preferably three, adjustment areas 1801, 1802, 1803 in which the command member 152 is fixedly positionable.

In accordance with a preferred embodiment, the adjustment opening 1800 is shaped in such a way to have a sliding area 1805 joining the adjustment areas 1801, 1802, 1803.

Preferably, therefore, the movements of the command member 152 are guided by the shape and by the edges of the adjustment opening 1800.

According to a preferred embodiment, the adjustment opening 1800 is surrounded by an adjustment slot 1850 suitable for guiding the adjustment button 1520.

According to a preferred embodiment, the sliding area 1805 is substantially linear, and at least one, preferably at least two, adjustment areas 1801, 1802, 1803 are transverse to the sliding area 1805.

According to a preferred embodiment, the first adjustment area 1801 is positioned at an axial end of the sliding area 1805.

In accordance with a preferred embodiment, the adjustment opening 1800 is substantially comb-shaped, thus determining a sliding area 1805 that joins the various adjustment areas 1801, 1802, 1803.

Preferably, the adjustment areas 1801, 1802, 1803 are shaped in such a way to prevent an undesired change in the position of the command member 182.

Preferably, some adjustment areas 1801, 1802, 1803 have edges or abutments suitable for holding the command member 182 in position. Preferably, the action of the thrust spring 151 and the shape of the adjustment areas 1801, 1802, 1803 hold the command member 182 in position. Preferably, in order to vary the position of the command member 182, the user must overcome the action of the thrust spring 151 by passing over said edges or abutments.

Preferably, the positioning of the command member 152 within an adjustment area distal from the engagement portion 110 of the trigger 100 corresponds to a lower thrust action of the thrust spring 155, and therefore to a softer action of the trigger 100, and therefore a lower trigger weight.

Preferably, the positioning of the command member 152 within an adjustment area near to the engagement portion 110 of the trigger 100 corresponds to a higher thrust action of the thrust spring 155, and therefore to a harder action of the trigger 100, and therefore a higher trigger weight.

According to a preferred embodiment, each adjustment area performs a compression action against the thrust spring 155, increasing the trigger weight from 100 to 300 grams, preferably by about 200 grams, compared to the previous adjustment region.

According to a preferred embodiment, the trigger assembly 10 comprises a trigger box 11 accommodating the adjustment device 150 and a trigger portion 100, in which said trigger box 11 is removably insertable into the firearm 1.

Preferably, the adjustment region 180 is formed on a side wall 13 of the trigger box 11.

According to a preferred embodiment, the adjustment opening 180 passes through a side wall 13.

Preferably, said trigger box 10 is insertable into the receiver 6 through the lower opening 65.

According to a preferred embodiment, the side walls 13 of the trigger box 11 engage the side walls of the receiver 6. According to a preferred embodiment, such walls are specially shaped with rails and guides suitable for allowing such mutual engagement. Preferably, such rails and guides extend axially. The trigger box 11 is insertable through the receiver 6 first in a vertical direction, then in an axial direction.

According to a preferred embodiment, the trigger 100 partially protrudes from the trigger box 11 accommodated in the receiver 6.

Preferably, the lower area of the trigger box 11 comprises a handguard 14.

Innovatively, the firearm which is the object of the present invention thoroughly fulfills the intended purpose thereof.

Advantageously, the firearm which is the object of the present invention is an alternative solution to those that are known.

Advantageously, the trigger group is adjustable by means of simple and intuitive operations.

Advantageously, the adjustment operations are error-proof.

Advantageously, the adjustment operations are guided.

Advantageously, the trigger group assembly and/or replacement operations are simplified and intuitive.

It is clear that a person skilled in the art may make changes to the invention described above in order to meet incidental needs, which changes all fall within the scope of protection as defined in the following claims.

The invention claimed is:

1. A firearm, comprising a trigger group operable by a user for controlling shooting action, wherein said trigger group comprises a trigger, which is rotatable with respect to a trigger axis and an adjustment device for adjusting intensity needed to operate the trigger comprising:

a rod movable by the trigger, extending axially between a trigger end and a free end;

a command member engaged with the rod, positionable in a predetermined axial operating position, wherein the rod is slidably engaged with the command member;

a thrust spring, acting on the rod between the trigger end and the command member, wherein elastic action of the thrust spring on the trigger is a function of the axial operating position of the command member.

2. The firearm according to claim 1, wherein the trigger comprises an engagement portion with which the trigger end of the rod is engaged.

3. The firearm according to claim 1, wherein the command member is positioned in at least two different operating positions.

4. The firearm according to claim 3, wherein the command member is movable by the user for positioning the command member in a preferred operating position, corresponding to a preferred position along the rod.

5. The firearm according to claim 3, wherein the command member comprises a command button and a protruding element, which extends from said command button, and which engages the rod, accommodating the rod in a through hole.

6. The firearm according to claim 1, wherein the trigger group comprises an adjustment region, which is engageable by the command member, wherein said adjustment region comprises an adjustment opening crossed by the command member, wherein said adjustment opening comprises three adjustment areas in which the command member is fixedly positionable.

7. The firearm according to claim 6, wherein said adjustment opening is shaped to have a sliding area for joining between the adjustment areas.

8. The firearm according to claim 7, wherein the sliding area is substantially linear, and at least one adjustment area is transverse to the sliding area.

9. The firearm according to claim 1, wherein the trigger group comprises a hammer device engaged by the trigger.

10. The firearm according to claim 1, wherein the trigger group comprises a trigger box accommodating the adjustment device and a trigger portion, in which said trigger box is removably insertable into the firearm.

11. The firearm according to claim 10, wherein the trigger group comprises an adjustment region, which is engageable by the command member, wherein said adjustment region comprises an adjustment opening crossed by the command member, wherein said adjustment opening comprises at least two adjustment areas in which the command member is fixedly positionable, and wherein the adjustment region is obtained on a side wall of the trigger box.

12. The firearm according to claim 11, wherein the adjustment opening passes through the side wall.

13. The firearm according to claim 1, comprising a fixed main body, comprising a housing cavity in which said trigger group is removably houseable.

14. The firearm according to claim 13, wherein said fixed body comprises a barrel extending along a barrel axis and a receiver from which said barrel extends, wherein the receiver comprises an upper opening and a lower opening, wherein the firearm further comprises a carriage assembly which is operable by the trigger group positioned on the receiver for closing the upper opening, wherein the firearm comprises a magazine insertable into said lower opening, in which the trigger box is insertable into the receiver through said lower opening.

15. The firearm according to claim 1, wherein said firearm is a rifle.

16. The firearm according to claim 1, wherein the command member is positioned in three different operating positions.

17. The firearm according to claim 1, wherein the trigger group comprises an adjustment region, which is engageable by the command member, wherein said adjustment region comprises an adjustment opening crossed by the command member, wherein said adjustment opening comprises three adjustment areas in which the command member is fixedly positionable.

18. The firearm according to claim 7, wherein the sliding area is substantially linear, and at least two adjustment areas are transverse to the sliding area.

19. The firearm according to claim 1, comprising a fixed main body, comprising a housing cavity in which said trigger box is removably houseable.

* * * * *